United States Patent [19]

Berstein et al.

[11] Patent Number: 4,747,286

[45] Date of Patent: May 31, 1988

[54] ROLLING APPARATUS

[75] Inventors: Garri Berstein; Willi Hansen, both of Erkelenz; Rudolf Winkens, Erkelenz-Gerderath, all of Fed. Rep. of Germany

[73] Assignee: W. Hegenscheidt GmbH, Erkelenz, Fed. Rep. of Germany

[21] Appl. No.: 902,154

[22] Filed: Aug. 29, 1986

[30] Foreign Application Priority Data

Aug. 30, 1985 [EP] European Pat. Off. ..... 85110948.8
Jan. 14, 1986 [EP] European Pat. Off. ..... 86100402.6

[51] Int. Cl.[4] ..... B21K 1/08
[52] U.S. Cl. ..... 72/110
[58] Field of Search ..... 29/6; 72/81, 110, 111, 72/442

[56] References Cited

U.S. PATENT DOCUMENTS 4,554,811 11/1985 Hayashi et al. ..... 72/110

FOREIGN PATENT DOCUMENTS 2544564 4/1977 Fed. Rep. of Germany ..... 72/84
193724 11/1984 Japan ..... 72/83

*Primary Examiner*—Lowell A. Larson
*Attorney, Agent, or Firm*—Herbert L. Lerner; Laurence A. Greenberg

[57] ABSTRACT

A rolling apparatus with a driving mechanism for a workpiece to be rolled and with at least one movable rolling device includes at least a die carrier with one rolling element and a die carrier with one backing element and including at least an additional one of the elements carried by at least one of the die carriers, the rolling element being changeable from one position thereof to at least another position thereof, one of the positions being a working position, at least one of the elements consisting of the rolling element in the working position thereof and at least one backing element associated therewith being kinematically connectible to a power actuating device.

18 Claims, 3 Drawing Sheets

ROLLING APPARATUS

The invention relates to a rolling apparatus with a driving mechanism for a workpiece to be rolled and with at least one movable rolling device having at least a die carrier with one rolling element and a die carrier with one backing element.

Such an apparatus can be employed, for example, to surface-harden or smoothen shafts, shaft trunnions, axles, fillet or transition radii arising when one workpiece region merges into another workpiece region of different dimension or different location, and they have become particularly well known and widely used and relied upon in practice in the form of so-called crankshaft rolling machines. They are also described extensively in the literature. In this regard, reference is made to German Published Non-Prosecuted Application (DE-OS) No. 33 33 603, for example. The aforementioned reference shows a surface-hardening rolling machine of the aforementioned type for rolling fillet radii on crankshafts.

A similar machine is shown also in German Pat. No. 31 08 746. Both machines have surface-hardening rolling devices suspended and disposed in such manner that master shafts are not needed for the suspension and guidance of these surface-hardening rolling devices. This type of suspension offers definite advantages for the adaption of the devices to crankshafts of different type with differently positioned bearing journals and different stroke lengths.

But there are also apparatus of the aforedescribed type which support the surface-hardening rolling devices via master shafts, as may be ascertained from German Pat. Nos. 32 24 286 and 31 08 780, for example.

The apparatus of the state of the art cited hereinbefore are able to adapt to differently positioned connecting-rod bearings of a crankshaft so that crankshafts of different type can be rolled.

For constructional reasons, the rolling dies respectively used in the apparatus are engineered strictly for the rolling job intended for them so that it becomes necessary to change the rolling dies as soon as even slight dimensional changes occur in the region of the workpiece which is to be rolled. This necessitates stopping the machine, and a manual exchange of dies occurs at each rolling device. Apparatus of this type are, therefore, suited only for the production of medium to large lots, but they are relatively easy to retool, especially for crankshafts of different type. However, small lot production is uneconomical.

It is accordingly an object of the invention to provide apparatus of the foregoing type which has improved efficiency due to the reduction in the time required for the machining of a workpiece and/or for retooling the machine; due to a less costly construction of the device required for this purpose; and due to greater flexibility of such a machine.

With the foregoing and other objects in view, there is provided, in accordance with the invention, a rolling apparatus with a driving mechanism for a workpiece to be rolled and with at least one movable rolling device comprising at least a die carrier with one rolling element and a die carrier with one backing element and including at least an additional one of the elements carried by at least one of the die carriers, at least one rolling element being changeable from one position thereof to at least another position thereof, at least one of the positions being a working position, at least one of the elements consisting of the rolling element in the working position thereof and at least one backing element associated therewith being kinematically connectible to a power actuating device.

Due to the fact that the respective rolling device is movable and connected to only one power actuating device, care is taken that the rolling force acts upon the workpiece only as a transverse force and is mutually cancelled out there. Additional transverse forces which could stress the workpiece and which stem from the power actuating device are avoided to a great extent. The presence of at least one additional rolling element and/or backing element having a position which is changeable in the manner described makes a die change unnecessary or superfluous for appropriate workpieces so that time is gained thereby in the production of larger lots. At the same time, greater flexibility of the apparatus is obtained thereby, because the apparatus according to the invention can react, within certain limits, to the workpiece construction through an appropriate change in position of the rolling elements and/or the backing elements. In the medium lot range, it is also imaginable to employ fewer rolling devices in a single apparatus and to feed them to the respective workpiece location to be rolled, thereby making a selection by appropriately repositioning the backing elements and/or the rolling elements so that a suitable die is applied to the respective workpiece site. Such an apparatus can also react to different workpieces so that it is unnecessary to provide an apparatus for each specific workpiece, nor is it necessary any longer to provide a rolling device for each workpiece location to be rolled.

In accordance with another feature of the invention, at least one of the elements consisting of the rolling element and the backing element is arranged so as to be changeable in position on the respective carrier. Due to the fact that at least one rolling element and/or backing element is disposed on the die carrier so as to be changeable in position, the construction of the apparatus can be simplified, at least for certain applications and, at the same time, the insertion of a workpiece into the apparatus can be facilitated through this changeability of position. The position changeability succeeds not only in bringing different elements to the working site when needed or desired, but also success is achieved in removing corresponding elements from the working site and returning them to the working site after a workpiece has been inserted.

In accordance with a further feature of the invention, the rolling element and the backing element, respectively, is an element of a roller head. Roller heads with rolling elements are already known and have proven out well. The use of such roller heads in an apparatus of the type according to the invention increases the efficiency of such an apparatus further in that the spare parts inventory can be reduced and restricted essentially to the roller heads. In addition, the use of such roller heads ensures a simpler construction of the apparatus.

In accordance with other features of the invention, an independent roller head is provided for each rolling element or rolling element pair and/or for each backing element or backing element pair. This ensures the standardization of the roller head construction so that identical roller heads can always be used even in machines having different number of rolling elements so that the different number of rolling elements is obtained simply by varying the roller heads. In accordance with an added feature of the invention, each of the roller heads is so disposed on a die carrier associated therewith as to be changeable in the position thereof. This provides a relatively simple way of bringing the respective roller head into a desired position.

In accordance with an additional feature of the invention there is provided a die holder provided on at least one of the die carriers, the die holder being changeable from one to another pre-determinable position, with at least one element of the rolling element and the backing element being movable into the positions by means of the die holder, at least one of the elements in working position being connectible kinematically to the power actuating device. A die holder which is changeable in position and equipped with appropriate rolling elements and backing elements, respectively, is relatively easy to realize structurally. Success is thereby achieved in supporting and guiding rolling elements and backing elements at the same time.

In accordance with yet another feature of the invention, the die holder is constructed as a roller head for the element. The idea behind the invention is thus able to be realized even when space conditions are cramped. At the same time, the overall construction is simplified thereby.

In accordance with an alternate feature of the invention, the die holder carries at least one roller head. This makes it possible, on the one hand, to equip the machine differently when adapting it to certain production conditions and, on the other hand, success is achieved, at least in part, by using roller heads which are already available.

In accordance with yet a further feature of the invention, there are provided at least two roller heads disposed so as to be changeable into a plurality of positions, at least one of the positions being the working position. With a simple arrangement of this kind, it is possible to handle a multiplicity of different workpiece dimensions.

In accordance with an alternative feature of the invention, the roller heads are disposed on a guideway for changing the position thereof. This is a simple and space-saving construction for executing a change in position. Together with the roller heads, the rolling elements and/or the backing elements are then changed in position thereof at the same time.

In accordance with yet an added feature of the invention, there is provided actuating means for performing the change in position of the roller heads. Actuating devices or actuators engineered specifically for executing a change in position and constructed and disposed accordingly are simple to realize and facilitate the execution of the change in position.

In accordance with yet an additional feature of the invention, the die holder has at least one position more than the number of roller heads carried thereby. Even in the event of a multiple arrangement of roller heads, this succeeds in attaining a position in which none of the roller heads present is in working position. This facilitates the complete exchange of the dies and, in particular, the replacement of broken surface-hardening rollers and, under certain circumstances, the work involving the insertion of the workpiece can be facilitated also.

In accordance with another aspect of the invention, there is provided a rolling apparatus with a driving mechanism for a workpiece to be rolled and with at least one movable rolling device comprising a pair of arms hinged scissorslike to one another and connected kinematically with a power actuating device for generating a rolling force. Such a construction permits the exertion of great rolling forces on the workpiece when the available space is limited, these rolling forces being cancelled out mutually on the workpiece itself so that an additional, undesired, radial load on the workpiece stemming from the rolling force is avoided. It must be emphasized at this juncture, that joining the arms in scissors fashion does not have to mean that a joint be present somewhat in the center of the arms. It is quite possible to place the joint, for example, also at one end of the arms and thus join the arm ends to one another. The other ends of the arms then carry the dies, and it is then possible to connect a power actuating device kinematically to these arms on one or the other side of the dies for generating the rolling force. Such a construction creates favorable lever ratios for generating the rolling force.

In other words, and this is noted expressly, the scissorslike connection hinging the arms to one another does not necessarily have to be constructed as shown in the drawing, although such a construction may also be especially purposeful. Basically, no scissorslike connection at all has to be provided, of course; rather, it is also possible to guide and move the carriers, for example, parallel to one another and to connect them kinematically to a power actuating device, so that the die carriers can be moved parallel towards one another and away from one another.

In accordance with a concomitant feature of the invention the rolling device has at least one element of a group consisting of rolling and backing elements, respectively arranged in fixed position relative to a die carrier associated therewith. It may be advantageous for certain applications to change rolling elements and/or backing elements or to bring them, respectively, into and out of the working position by repositioning the entire rolling device accordingly. The rolling elements and/or backing elements must then be disposed in fixed position relative to the associated die carrier. An apparatus according to the invention may be equipped either with one or more rolling devices. The rolling devices may also be of different types. The workpiece may be driven centrally via a separate workpiece drive. But it is also possible, especially when crankshafts are involved, to have the various rolling devices carry the workpiece, on the one hand, and drive it on the other hand. A crankshaft is advantageously supported and guided by the rolling devices for the main bearings and driven by the rolling devices for the connecting rod bearings. Rolling devices for the main bearings are not absolutely necessary, however, for seating and guiding the crankshaft. Driving the crankshaft via the connecting rod bearings is advantageous especially when the rolling devices are carried and moved via master shafts. It is also possible, in an apparatus according to the invention, to combine rolling devices according to the invention with rolling devices of conventional type.

Furthermore, it is possible, in an apparatus according to the invention, to construct rolling devices according to the invention which can travel along a workpiece axis so that the rolling devices can be moved into desired and preprogrammed working positions via appropriate driving and controlling means such as programmable NC controls. In this connection, the program may not only effect the positioning of the rolling devices themselves, but also the selection of the dies to be brought into position.

Other features which are considered as characteristic for the invention are set forth in the appended claims.

Although the invention is illustrated and described herein as embodied in a rolling apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Described herein by way of example is an apparatus according to the invention in the form of a crankshaft rolling machine of a basic construction generally known in the cited state of the art.

Figure 1:
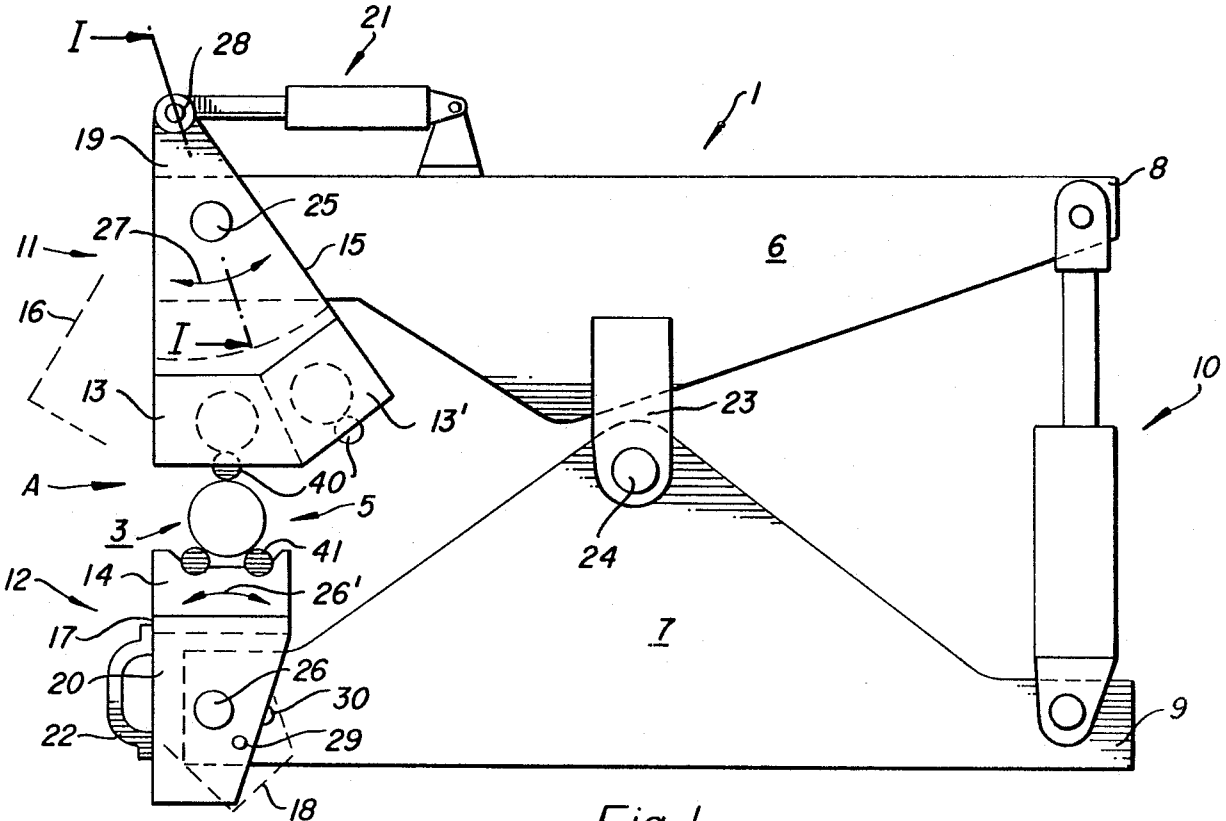
FIG. 1 is a side elevational view of one embodiment of a surface-hardening rolling device according to the invention.
Figure 2:
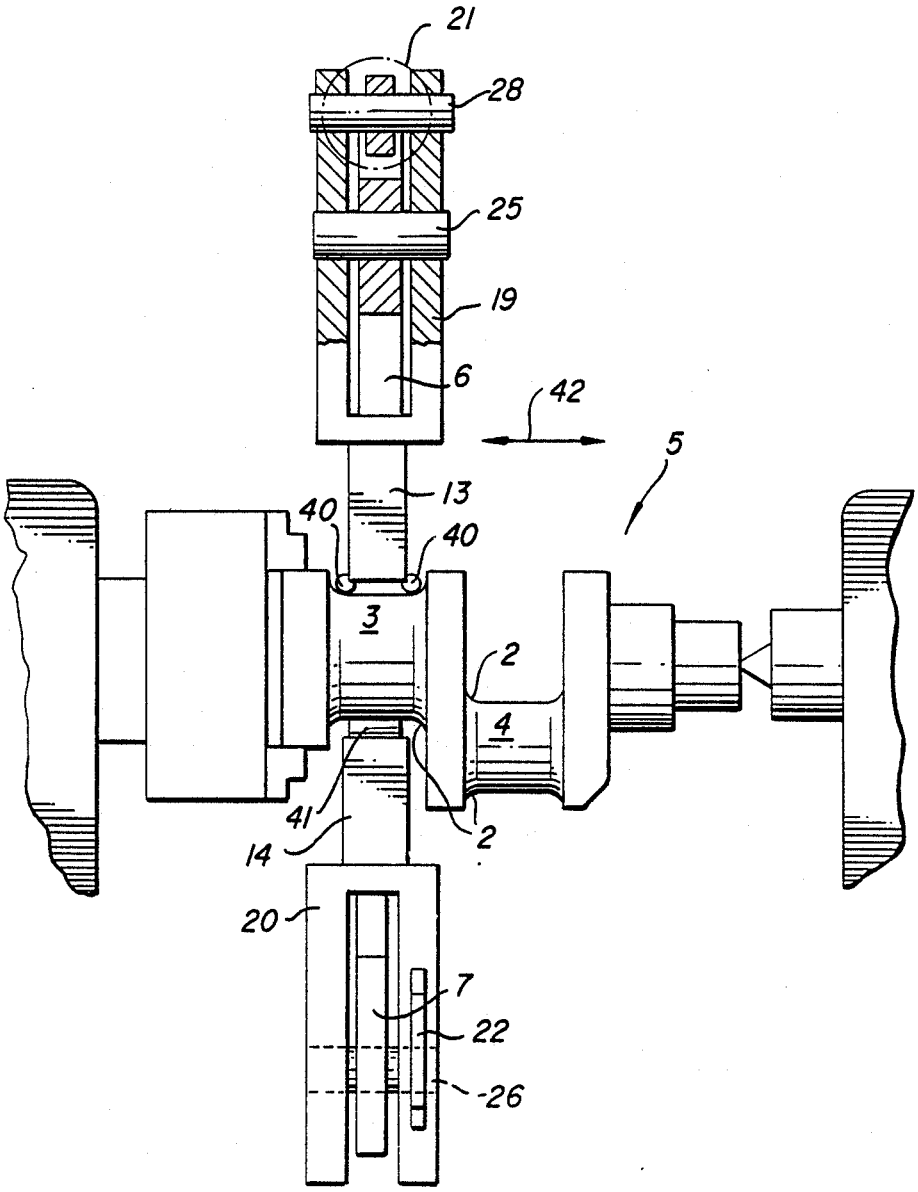
FIG. 2 is an enlarged front elevational view of FIG. 1 as seen in the direction of the arrow A.

Referring now to the drawing and first, particularly, to FIGS. 1 and 2 thereof, there is shown such a machine having at least one surface-hardening rolling device 1 formed primarily of two arms 6 and 7. These arms 6 and 7 may be hinged to one another in conventional scissors-like manner via plates or webs 23 and a pivot pin 24. Disposed at mutually opposite rear ends 8 and 9 in a likewise conventional manner is a piston/cylinder unit 10 which moves the arms 6 and 7 in a manner similar to that for a pair of pliers or scissors. According to the present state of the art, a respectively required roller head is disposed at an end 11 of the arm 6 opposite the end 8 thereof and at an end 12 of the arm 7 opposite the end 9 thereof. In the surface hardening rolling device according to the invention, on the other hand, pivot pins 25 and 26, respectively, are provided thereat which articulatingly support forkshaped levers 19 and 20, respectively. The levers 19 and 20 can thus pivot freely about the pivot pins 25 and 26, respectively, as indicated by the arrows 27 and 26'.

A piston rod of a piston/cylinder unit 21 is connected to one end of the lever 19 via an articulating joint 28 while a cylinder of the piston/cylinder unit 21 is braced against the arm 6. In the indexing position shown in FIG. 1, the lever 19 is in an angular position 15. Disposed at the other end of the lever 19 opposite the one end thereof are conventional surface-hardening rolling dies 13 and 13' constructed as double dies in the illustrated embodiment of FIGS. 1 and 2. In the angular position 15 of lever 19, the surface-hardening roller head 13 is in working position.

The backing roller head 14 mounted on the lever 20 is disposed in a conventional manner opposite the surface-hardening roller head 13. The angular position 17 of the lever 20 keeps the backing roller head 14 in working position so that fillet or transition radii 2 can be rolled on the main bearing 3. This requires that the levers 6 and 7 be moved by the piston/cylinder unit 10 in a conventional manner so as to cause the surface-hardening roller head 13 and the backing roller head 14 to contact the respective bearing points of the crankshaft 5. Of course, it is not only the main bearing 3 of the crankshaft 5 which can be surface-hardened in this manner, but also equally as well the connecting rod bearing 4 in the region of the fillets 2 thereof. All that is required is that an appropriate device be additionally provided. The multiple arrangement of such devices, however, has become known heretofore from the hereinafore cited literature pertaining to the state of the art. Therefore, a detailed description of such a multiple arrangement is believed to be unnecessary here. The cited literature pertaining to the state of the art may be referred to in this context. It is also possible, however, to move the apparatus 1 and 1', respectively, axially from machining site to machining site, as indicated by the arrow 42 in FIG. 2.

To machine the crankshaft 5, it may be checked between centers, as shown in FIG. 2 and centrally driven so that the surface-hardening rolling device 1 does not have to be suspended via master components or shafts. As an alternative, however, it is possible as well to mount the crankshaft 5 in the surface-hardening rolling devices 1 without centers and to guide and drive the surface-hardening rolling devices 1 via master shafts.

Machining of the crankshaft can then be performed in a manner already known in the state of the art. If a crankshaft with, for example, different fillet radii should then arrive as the next workpiece, the surface-hardening roller head 13' may be adapted for this task. In order to be able then to surface-harden the crankshaft with the different fillet radii 2, the piston/cylinder unit 21 is actuated so that its piston rod retracts. This causes the lever 19 to move from the angular position 15 to the angular position 16 represented by broken lines. This brings the surface-hardening roller head 13' into working position, and the crankshaft 5 with the different radii can be rolled by means of the rolling elements 40. The pivoting motion of the lever 19 in the direction of the arrow 27, of course, is by no means restricted to the two indexing positions described with respect to the embodiment of FIGS. 1 and 2. More than two indexing positions may be provided. By the same token, more than two surface-hardening roller heads, also with respectively different rolling elements 40, may be used. Depending upon the particular use or application, it is also sensible to provide only a single surface-hardening roller head 13, for example, when the then possible outwardly swinging motion via the lever 19 should only or preferably additionally serve the purpose of simplifying the die change for the die 13 or, in case of fracture or failure of the rolling elements 40, of simplifying the replacement of the rolling elements by improving the accessibility thereof. Such an outwardly swinging motion, however, can also simplify the insertion of the workpiece.

Figure 3:
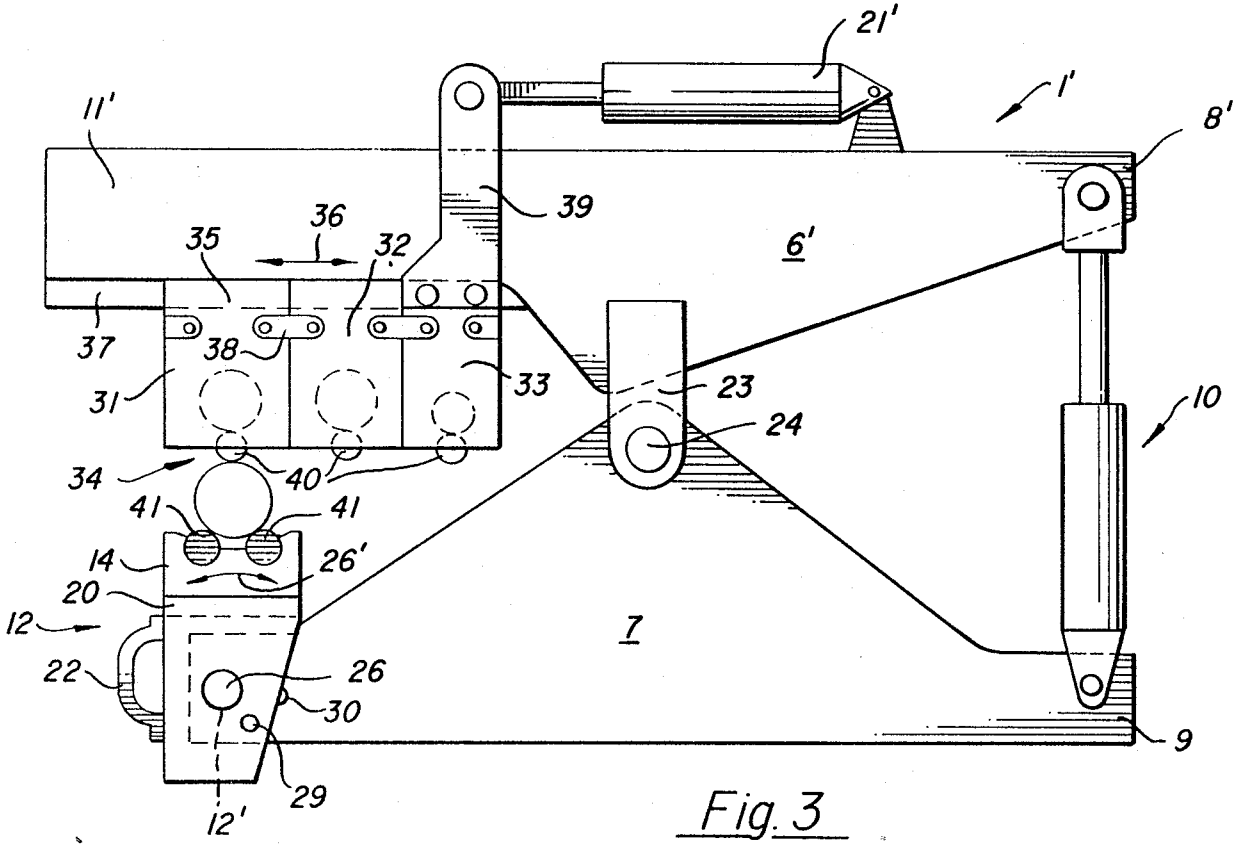
FIG. 3 is a view like that of FIG. 1 of another embodiment of the device.

The backing roller head 14 can also be pivoted, for example, by means of a handle 22, in the direction of arrow 28 from the angular position 17, which represents the working position, into the angular position 18. All that is required to accomplish this is the removal of the locking bolt 29 so that the lever 20 can then be pivoted effortlessly by means of the handle 22. The locking bolt 29 is then reinserted in the angular position 18 and is then seated in a hole 30 formed in the arm 7. In this pivoted position, the backing roller head 14 can be exchanged effortlessly. It is also conceivable, however, to construct the lever 20 like the lever 19 so that the lever 20 can carry several different backing roller heads for different bearing shapes. A surface-hardening rolling device 1' according to FIG. 3 is essentially of a construction quite similar to that of the aforedescribed surface-hardening rolling device of FIGS. 1 and 2. The arm 7 with the backing-roller head 14, which is mounted on the arm 7 via the lever 20 so as to pivot about the pivot pin 26, can be of exactly the same construction as has already been described in connection with FIG. 1. This lever 7 is again hinged to an arm 6' by means of the pivot pin 24 and the plate or web 23, and the rear ends 8' and 9 of the arms 6' and 7, respectively, are connected to a piston/cylinder unit 10 which is to effect the pivoting motion of the arms 6' and 7 relative to one another and which generates the required rolling force.

The construction of the arm 6' of FIG. 3 differs from that of the arm 6 of FIG. 1. In the region of the front end 11' of the arm 6', it has on the underside thereof a slide guideway 37 on which one or more slides 35 may be disposed. The one or more slides 35 are movable in the direction of the double-headed arrow 36. In the embodiment of FIG. 3, the slides 35 carry surface-hardening roller heads 31, 32 and 33 which, in turn, contain rolling elements 40. Because several slides 35 are provided in the embodiment of FIG. 3, the surface-hardening roller heads 31 through 33 are interconnected by brackets or straps 38. The surface-hardening roller head 31 is shown in working position in FIG. 3, while the surface-hardening roller heads 32 and 33 are shown available for a roller-head change.

To execute a shifting motion of the roller heads 31 through 33 on the slide guideway 37, the roller head 33 with its associated slide 35 is connected to the piston/-cylinder unit 21' via an arm 39. A retracting or extending motion of the piston rod of this piston/cylinder unit 21' effects a corresponding motion of the slides 35 and, hence, of the roller heads 31 through 33 in the direction of the arrow 36. Thereby, any desired roller head can be brought into or out of the working position 34. In the respective working position 34, the roller head which is in working position can be locked mechanically or kept therein by a position control of the piston in the piston/-cylinder unit 21'.

It is quite possible with this construction to make the respective slide 35 an integral part of the roller head to be associated therewith. It is also possible to construct several roller heads as one structural unit so that only one roller head is present as a subassembly which, however, has several work stations.

By the same token, it is also possible, of course, to use a roller head arrangement, as described hereinbefore with regard to the lever 6', also in the form of backing roller heads on the arm 7. All that is then necessary is to construct the front end 12' of the arm 7 like the front end 11' of the arm 6'.

The aforedescribed surface-hardening rolling device may be used both in surface-hardening rolling machines according to the state of the art cited at the introduction hereto and also as a separate or individual apparatus. It is also possible to dispose the rolling element 40 and/or the backing elements 41 in fixed position relative to the associated die carrier and to move the die carrier itself or the entire apparatus in order to effect the change in position, or to change its position in another way. Of course, it is also possible to provide additionally for a die carrier or the entire apparatus to be movable or changeable in position.

The foregoing is a description corresponding, in substance, to European application No. 85 110 948.8, dated Aug. 30, 1985, International priority of which is being claimed for the instant application, and which is hereby made part of this application. Any material discrepancies between the foregoing specification and the specification of the aforementioned corresponding German application are to be resolved in favor of the latter.

We claim:

1. Rolling apparatus with a driving mechanism for a workpiece to be rolled and with at least one movable rolling device comprising at least a die carrier with one rolling element and a die carrier with one backing element and including at least an additional one of said elements carried by at least one of said die carriers, at least one rolling element being changeable from one position thereof to at least another position thereof, at least one of said positions being a working position, at least one of the elements consisting of said rolling element in said working position thereof and at least one backing element associated therewith being kinematically connectible to a power actuating device.

2. Apparatus according to claim 1 wherein at least one of the elements consisting of said rolling element and said backing element is arranged so as to be changeable in position on the respective carrier.

3. Apparatus according to claim 1 wherein said rolling element and said backing element, respectively, is an element of a roller head.

4. Apparatus according to claim 3, including a respective independent roller head for each of said rolling elements.

5. Apparatus according to claim 3, including a respective independent roller head for each of said backing elements.

6. Apparatus according to claim 3 wherein said additional element is a rolling element forming with said one rolling element a respective rolling element pair, and including a respective independent roller head for said rolling element pair.

7. Apparatus according to claim 3 wherein said additional element is a backing element forming with said one backing element a respective backing element pair, and including a respective independent roller head for said backing element pair.

8. Apparatus according to claim 3 wherein each of said roller heads is so disposed on a die carrier associated therewith as to be changeable in the position thereof.

9. Apparatus according to claim 1 including a die holder provided on at least one of said die carriers, said die holder being changeable from one to another predeterminable position, with at least one element of said rolling element and said backing element being movable into said positions by means of said die holder, at least one of said elements in working position being connectible kinematically to said power actuating device.

10. Apparatus according to claim 9, wherein said die holder is constructed as a roller head for said element.

11. Apparatus according to claim 10 wherein said die holder has at least one position more than the number of roller heads carried thereby.

12. Apparatus according to claim 9 wherein said die holder carries at least one roller head.

13. Apparatus according to claim 1, including at least two roller heads disposed so as to be changeable into a plurality of positions, at least one of said positions being said working position.

14. Apparatus according to claim 13 wherein said roller heads are disposed on a guideway for changing the position thereof.

15. Apparatus according to claim 13, including actuating means for performing the change in position of said roller heads.

16. Apparatus according to claim 15 wherein said actuating means is a fluid-actuated piston/cylinder unit.

17. Rolling apparatus with a driving mechanism for a workpiece to be rolled and with at least one movable rolling device according to claim 1 comprising a pair of arms hinged scissorslike to one another and connected kinematically with a power actuating device for generating a rolling force.

18. Rolling apparatus according to claim 17, wherein said rolling device has at least one element of a group consisting of rolling and backing elements, respectively arranged in fixed position relative to a die carrier associated therewith.

* * * * *